US005957584A

United States Patent [19]

Lakey

[11] Patent Number: 5,957,584

[45] **Date of Patent: *Sep. 28, 1999**

[54] FLEXIBLE TAMPER-EVIDENT PACKAGE WITH INTEGRAL FITMENT

[76] Inventor: Michael D. Lakey, 8547 San Fernando Way, Dallas, Tex. 75218

[ * ] Notice: This patent issued on a continued prosecution application filed under 37 CFR 1.53(d), and is subject to the twenty year patent term provisions of 35 U.S.C. 154(a)(2).

[21] Appl. No.: 08/730,971

[22] Filed: Oct. 16, 1996

Related U.S. Application Data

[60] Provisional application No. 60/011,035, Feb. 20, 1996.

[51] Int. Cl.[6] ..... B65D 33/34; B65D 39/00

[52] U.S. Cl. ..... 383/5; 383/61; 383/96; 383/104; 383/201; 383/204; 383/209; 383/906

[58] Field of Search ..... 383/4, 5, 33, 35, 383/36, 200, 201, 202, 203, 204, 207, 208, 209, 41, 42, 43, 44, 48, 53, 54, 61, 62, 66, 67, 80, 95, 96, 107, 104, 904, 906, 210, 211

[56] References Cited

U.S. PATENT DOCUMENTS

| | | | |
|---|---|---|---|
| 3,342,326 | 9/1967 | Zackheim | 383/210 X |
| 3,520,471 | 7/1970 | Faust | 383/906 X |
| 3,545,604 | 12/1970 | Gunther, Jr. | 383/202 X |
| 3,799,914 | 3/1974 | Schmit et al. | 383/904 X |
| 4,119,128 | 10/1978 | Bishop | 383/200 X |
| 4,266,692 | 5/1981 | Clark | 383/210 X |
| 4,305,521 | 12/1981 | Komatsuta et al. . | |
| 4,560,081 | 12/1985 | Adams . | |
| 4,783,176 | 11/1988 | Ichikawa | 383/80 |
| 4,834,743 | 5/1989 | Valerio . | |
| 5,054,631 | 10/1991 | Robbins, III . | |
| 5,060,833 | 10/1991 | Edison et al. . | |
| 5,188,283 | 2/1993 | Gu . | |
| 5,312,189 | 5/1994 | Aeschbach et al. | 383/906 X |
| 5,353,955 | 10/1994 | Kaufman et al. . | |
| 5,564,591 | 10/1996 | Christine et al. | 383/80 X |
| 5,758,473 | 6/1998 | Patelli | 383/906 X |

FOREIGN PATENT DOCUMENTS

| | | | |
|---|---|---|---|
| 0586787 | 3/1994 | European Pat. Off. . | |
| 2671052 | 7/1992 | France | 383/200 |

*Primary Examiner*—Jes F. Pascua
*Attorney, Agent, or Firm*—Sidley & Austin

[57] ABSTRACT

A flexible package having an integral fitment and integral protective tamper-evident structure protecting said fitment until removal of said protective structure by a user, is disclosed.

3 Claims, 1 Drawing Sheet

FLEXIBLE TAMPER-EVIDENT PACKAGE WITH INTEGRAL FITMENT

CROSS-REFERENCE TO RELATED APPLICATIONS

This application claims the benefit of prior filed U.S. Provisional Application No. 60/011,935, filed Feb. 20, 1996, now abandoned.

FIELD OF THE INVENTION

The invention relates to the field of flexible lightweight packaging for beverages as well as other consumer products such as creams, powders and cosmetics.

BACKGROUND OF THE INVENTION

In the past few years, portability of beverage containers has become of increased importance as consumers began to prefer disposable, lightweight beverage containers. In addition, it has been increasing popular to provide consumer-sized packages of drinking water so that the consumer can control the purity and sterility of the water consumed at any location. To satisfy this demand, plastic bottles, made for example from polyethylene terephthalate, have been used to package drinking water. Various caps have been provided for such bottles so that the consumer can be assured that no contamination has occurred to the beverage inside. As an example, a threaded cap has been provided which can be unscrewed from complementary threads molded into the bottle material in a conventional manner. A portion of the cap breaks loose from another portion of the cap, forming a ring, due to the unscrewing action. Therefore prior to initial consumption, the consumer is assured that the package has not been tampered with as long as the ring has not already been detached. Another approach to providing a tamper-evident container to consumers has been with the so-called "sports bottles." A cap is provided that has a spout. The spout may be placed in either an open position or a closed position. In this case, the entire cap need not be unscrewed from the bottle. The spout can be moved to the opened position which allows liquid contents to be released and returned to the closed position when it is desired to once again seal the bottle. With this type of cap, it has been necessary to provide features which show the consumer that the bottle has not been tampered with. An approach to this problem has been to shrink wrap the spout and/or entire cap portion of the bottle. In some instances, a peel-off film is also provided over the top of the bottle opening. The consumer must then remove the cap by unscrewing, peel off the film, and replace the cap. The shrink wrap on the spout must also be removed prior to drinking from the spout.

Another approach to the problem of beverage portability has been to provide flexible beverage pouches. Examples of such pouches are laminated foil pouches which have a designated area weaker than the result of the pouch, typically in the side of the pouch. An aperture can be formed by poking a sharp straw through this designated area on the pouch. The straw then is used by the consumer to drink the beverage contained in the flexible packaging. While convenient, such pouches are not tamper evident. Another approach to flexible drinking packaging, an alternative to the poke-through straw approach, has been disclosed. In this approach, a fitment is sealed to the side of the pouch. An aperture in the pouch is defined by a first end of the fitment. The fitment is threaded in a manner adapted to receive a cap with complementary threads. An opening defined by the second end of the fitment to the atmosphere may be sealed with a flexible material such as a foil. A threaded cap is provided which can be screwed onto the fitment sealed into the side of the bag. With this type of package, the consumer may remove the cap, peel off the foil and then drink the beverage through the spout. When the consumer desires to seal the pouch, he may do so by screwing the cap on the fitment.

Although the approaches to portability of beverages have provided suitable containers, such containers have also introduced a variety of problems. With respect to plastic bottles, not all types of plastic are recyclable and even if recyclable, this property is not always taken advantage of by the consumer. It is difficult to attain the goals of using disposable portable packaging along with the goals of recycling. Further, if the caps are replaced on bottles before they are taken to a landfill, the bottles will not compress and thus will take up a great deal of room in the ever-shrinking supply of landfills. In addition, assuring that the package has not been tampered with increases expenses to the manufacturing process. The package must go through one or more additional stages of manufacture after filling of the bottle with the beverage of choice in order to insure that the package is sealed. This requires the bottler to purchase additional equipment in order to insure that the package is tamper-evident upon sale.

With respect to the flexible beverage containers, it is often difficult to poke the sharp straw through the designated opening. This operation sometimes results in the beverage being spilled while the user attempts to make the package into a workable beverage dispenser. Furthermore, if the straw has been lost or misplaced, it becomes impossible to use the package in the manner intended by the manufacturer. The straws must be sealed separately for sanitation, requiring additional manufacturing operations. If the packaged straws are adhered to the packages of beverage, yet another operation is needed.

The approach to the problem which involves providing a fitment sealed into the side of a flexible package solves the problem of the possibility of the straw implement being separated from the package since the consumer can easily unscrew the cap, peel back the foil and access the beverage. However, this packaging requires several manufacturing steps as well as the fitments which add expense to the operation.

In addition to the beverages, there has been a need for packaging items such as shampoos, cosmetics, lotions and creams, and powders in an inexpensive, yet tamper-evident manner. Particularly where individual or travel-sized portions are desired such as in hotels and the like, packaging costs can skyrocket when tamper-evident features are employed. The simple individual foil pouch, such as those used for a wide range of products from ketchup to suntan lotion are convenient only if all the contents are utilized at once since they have no resealing features.

SUMMARY OF THE INVENTION

A new package is now provided which solves many of the problems discussed above. The package provides a hermetically sealed tamper-evident container for beverages or other consumer goods which can be manufactured in a continuous operation with little additional manufacturing expense. The package contains a fitment or straw sealed into the package which in a preferred embodiment contains a fitment sealing means, preferably a resealing cap. The consumer uses the package by tearing off the portion protecting the straw or fitment along perforations provided. The straw or fitment remains sealed to the package, and the consumer can drink the beverage through the straw or fitment or otherwise obtain the product which has been packaged therein. The resealing cap allows the consumer to save a portion of the contents for later use.

DETAILED DESCRIPTION

A tamper-evident package 10 is disclosed made of flexible packaging material and having an integral fitment 70 comprising a spout or straw. A portion of the package as manufactured is removable by the user, revealing the top of the integral fitment 70 through which the user can drink a beverage contained therein or remove whatever contents may have been packaged therein. A major advantage of the package disclosed is that in a landfill, one hundred packages are approximately equivalent in volume to just one plastic bottle (where the package and the bottle held similar contents volumes). This provides an enormous environmental advantage, without compromising the positive aspects of the plastic bottle: resealing capabilities and tamper-evident features. Even the ability to stand up on a surface can be provided in the disclosed package. The flexible package of the invention is portable, disposable and may be manufactured without investment in either blow molding equipment or separate tamper-evident manufacturing equipment since the tamper-evident features are built into the device through the structure which may be accomplished with heat-sealing equipment for films with modest adjustments.

The package of the invention is preferably made through a manufacturing technique using film for the packaging material. The film should be a flexible packaging material which is heat-sealable and compatible with the ingredients of the desired beverage or other contents. The preferred material will be on a roll to ease manufacturing procedures. A preferred material is a laminated polyester and polyethylene. The polyethylene will preferably be used on the inside of the package, next to the beverage or other contents. Polypropylene may also be used as can any flexible material compatible with the desired ingredients.

Figure 1:
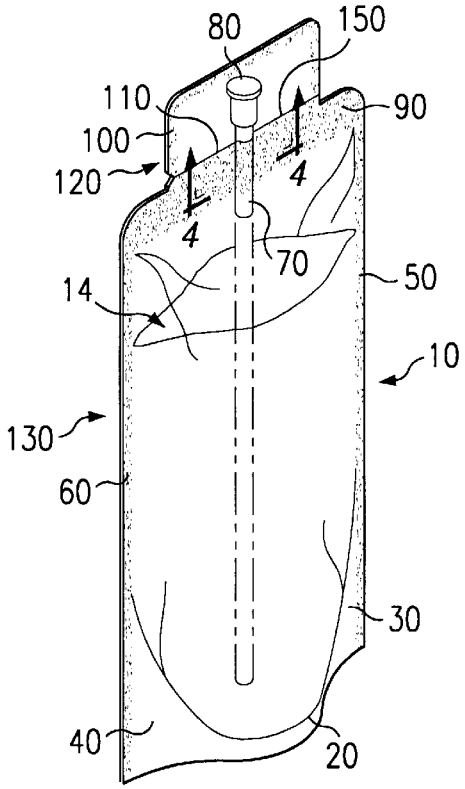
FIG. 1 is a perspective view showing an example flexible tamper evident package as manufactured.
Figure 2:
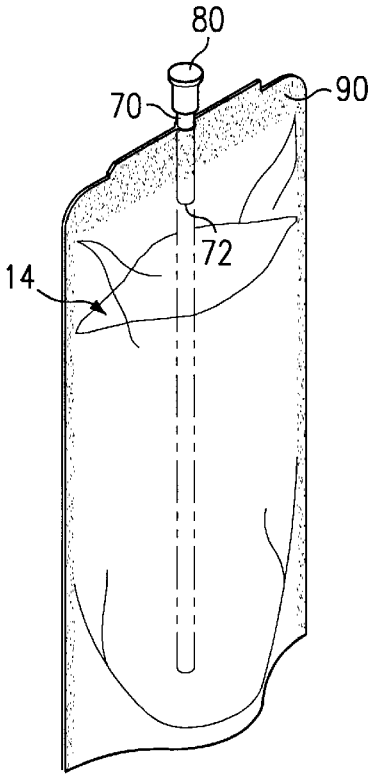
FIG. 2 is a perspective view showing the package of FIG. 1 with the tamper evident section 120 removed as would be done by the consumer just prior to use.
Figure 3:
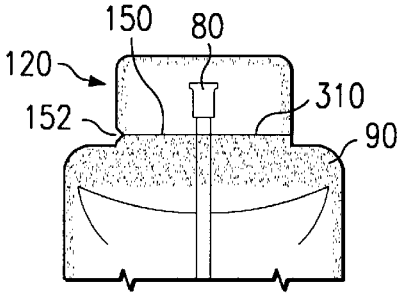
FIG. 3 is a partial front view.
Figure 5:
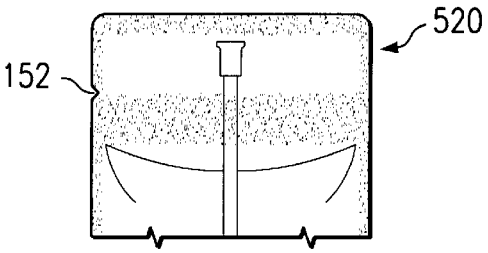
FIG. 5 is a partial front view showing alternative tamper evident section 520 which has not been die cut.
Figure 6:
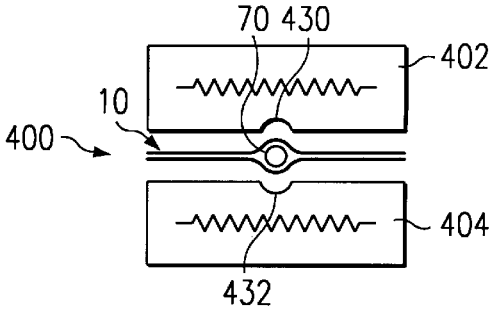
FIG. 6 is an illustrative view showing the general configuration of heat seal and perforation elements used in manufacturing the flexible tamper evident package.

The film is folded in the center and in a preferred embodiment a gusset is created, sealed and cut to form a stand-up pouch, by methods such as have been known in the packaging art for several years. A pouch is formed by heat sealing along the edges of the film material thus forming a pouch with a sealed bottom and sides and an unsealed top edge. The pouch is then blown open with air and the pouch is filled with the desired contents. A fitment or straw 70 is then inserted in the pouch adjacent the top edge, either by hand or preferably by use of a mechanized arm. The fitment or straw 70 can extend just into the interior of the pouch or all the way into the beverage or contents. The fitment or straw is held into the desired position while a heat-seal mechanism, adapted to accommodate the shape of the fitment, seals the top of the bag a sufficient distance down from the top of the bag so to create a bottom compartment 130 for the beverage or contents and a top compartment 120 for the top of the fitment 70. As one specific example, for an average beverage bag approximately 11½" in height by 4½" in width, the heat-seal may be placed 1" to 2½" down, creating a beverage compartment about 8" high, a sealed area ⅜ to 1" wide and a top compartment about 1½" high. The exact distance would be varied to accommodate the size of the package desired as well as the size of the fitment. A heat sealing mechanism is molded to accommodate the fitment and seal desired and to seal the fitment into place as is best seen in FIG. 6. The fitment may have an optional fitment sealing means, preferably a cap 80 which is either already in place at the time the fitment is placed in the position or another mechanical arm or mechanism may insert the cap 80 on the fitment prior to creation of the tamper-evident compartment. The fitment sealing means may be a heat seal which may be clipped off by the user or any means that can seal said fitment. The fitment may be of any desired shape such as cylindrical or ovoid. Beveled fitments may be provided to improve the seal. At a final station, the pouch material is sealed around the top of the straw forming a hermetically-sealed package converting the top compartment into a tamper-evident compartment seal. A tear strip can be incorporated above the seal or the film is lightly scored along score line 150 above the seal to allow the user to tear the top compartment 120 off the package to expose the end of fitment 70 and cap 80. A notch 152 can be formed to assist the tearing action along score line 150. While shown as a V notch in FIGS. 1, 3 and 5, the notch can be a simple slit or cut which provides the same concentration of stress to initiate a tear in the desired direction. Alternatively, perforations can be built into the final station which provide perforations in the sealed area of package 10 adjacent the fitment. Alternatively, perforations can be provided in the package after the operations have occurred with an appropriate mechanized device. The top compartment of the package above the seal can be die cut to any desired shape prior to conversion to the tamper-evident compartment. In FIGS. 1, 2, and 3, the package has been die cut above bottom compartment 30 to form a bottle-shaped package.

Figure 4:
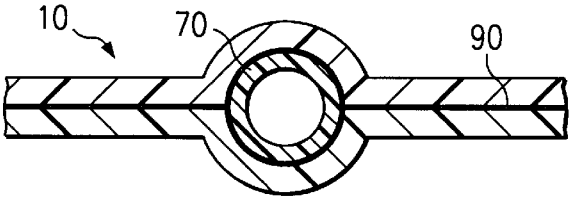
FIG. 4 is a cross section taken along line 4—4 of FIG. 1.

In use, the consumer tears off the protective compartment 120 at the score lines 150 (or using the tear strip or perforations) and removes the tamper-evident compartment 120, leaving an exposed fitment or straw 70 and a cap 80 to open, reseal and reclose as desired. In a preferred embodiment, referring to FIG. 1, package 10 is formed from a single sheet of film folded along line 20 gusseted and sealed in areas 30 and 40 to form a stand-up pouch construction, the method for construction of which is known in the art. A container is formed for package 10 by heat sealing along line 50 and line 60 to form the sides of the package. After filling of package 10 with a beverage or other contents of choice 14, fitment 70 is inserted into the interior of package 10, adjacent the open top edge then present (not shown) and held in place, preferably by a mechanical arm. Fitment 70 can be of various lengths depending on the desired purpose and the identity of the contents. It is made of material sealable to the package film, preferably heat sealable. One example is shown in solid line which extends into lower contents compartment 130, but not into contents 14 when the package is in an upright position. A second example length is shown by considering the solid and dashed lines for fitment 70, illustrating that fitment 70 may extend into the contents as packaged. For example, a full-sized straw may be used as a fitment. Removable cap 80 may be provided for fitment 70 so that fitment 70 can be recapped if desired after a desired portion of the contents are removed. The package 10 is then heat sealed in seal area 90 to form a leak-proof lower contents compartment 130 for the beverage. Fitment 70 is heat sealed to the bag film during this operation. This can be best seen in cross section in FIG. 4, which shows fitment 70 and seal 90 in cross section between the folded over film sheet comprising package 10. Referring now to FIG. 6, which illustrates forming of seal area 90 and scoring of the same, a heat seal mechanism 400 is modified in areas 430 and 432 to accommodate fitment 70. A die with a score line may be provided to form score line 150 with a tear notch 152 shown in FIGS. 1 and 3 or a notch without a score line as shown in FIG. 5. In operation, first heat sealer section 402 and second heat sealer section 404 are brought together with the folded film sheet comprising 10 and fitment 70 therebetween. Heat seal 90 (FIG. 1), notch 152 and score line 150 (FIG. 1) are thereby formed.

A tamper-evident seal 100 (FIG. 1) is then made with heat seal equipment (not shown) to form a hermetically sealed flexible pouch assembly having a lower contents compartment 130 and upper tamper-evident compartment 120. Score line 150 can be alternatively made after either seal 90 or seal 100 are made. Upper compartment 120 is defined by seal 90 at its bottom and seal 100 at its sides and top.

Rather than using a score line 150, a tear strip tape could be applied across the film in line with the notch 152 just above seal 90. A film could also be used with a grain that tears in the direction desired by reason of the properties of the film itself as shown in FIG. 5. This film might or might not have a tear notch 152 or score line 150. FIG. 5 illustrates use of notch 152 but no score line 150. The grain of the film used in the package 10 of FIG. 5 is such as to propagate a tear initiated at notch 152 along the film in the same direction as score line 150 would have done so.

Referring now to FIG. 2, the flexible drinking pouch assembly of FIG. 1 is shown after tamper-evident compartment 120 has been removed by tearing the film comprising the package along score line 150. Seal 90 remains intact and the user is able to drink a beverage by removal of fitment cap 80 and aspirating the beverage through fitment 70. Where fitment 70 does not extend into contents 14, ending at end 72, the bag can be tipped (for liquids) or squeezed (for creamy or viscous contents) so that the contents flows out through fitment 70. As in FIG. 1, the solid line illustrates a shorter fitment and the solid plus dashed line a larger fitment continuing past end 72.

In FIG. 5, area 520 is depicted. This is an alternative embodiment in which no die cut has been made in the film forming package 10 such as is shown in FIGS. 1 and 3. The die cut is optional to provide a desired shape but is not necessary as is shown in FIG. 5. Die cutting mechanisms for film are well-known in the art.

Although the present invention and its advantages have been described in detail, it should be understood that various changes, substitutions and alterations can be made herein without departing from the spirit and scope of the present invention as defined by the appended claims.

I claim:

1. A flexible package comprising an interior and an exterior, a first contents compartment formed from a sealed flexible film, a second tamper-evident compartment formed from said sealed flexible film, a drinking straw seal area between said first and said second compartments, a drinking straw extending from said first compartment to said second compartment through which a contents contained in said first compartment can pass, said drinking straw being fixedly sealed to said drinking straw seal area preventing movement of the drinking straw relative to said drinking straw seal area, the seal being fluid tight, whereby a user may remove said second compartment from the package and thereby gain access to said contents which can be removed from said first compartment through said drinking straw;

a removable and resecureable cap secured to a portion of said drinking straw which is extended into said tamper evident compartment, said cap capable of preventing fluid from said contents compartment from entering said tamper evident compartment while the package is unopened, said removable cap being removable from said drinking straw after the user removes said second compartment from the package to remove contents from said first contents compartment and being subsequently resecureable to the portion of the drinking straw to prevent contents from the first contents compartment being removed therefrom to reseal the flexible package; and a score line extending straight across said drinking straw seal area, said score line facilitating tearing of said flexible film for removal of said tamper evident compartment.

2. A flexible package comprising an interior and an exterior, a fit contents compartment formed from a sealed flexible film, a second tamper evident compartment formed from said sealed flexible film, a drinking straw seal area between said first and said second compartments, a drinking straw extending from said first compartment to said second compartment through which a contents contained in said first compartment can pass, said drinking straw being fixedly sealed to said drinking straw seal area preventing movement of the drinking straw relative to said drinking straw sea1 area, the seal being fluid tight, whereby a user may remove said second compartment from the package and thereby gain access to said contents which can be removed from said first compartment through said drinking straw;

a removable and resecureable cap secured to a portion of said drinking straw which is extended into said tamper evident compartment, said cap capable of preventing fluid from said contents compartment from entering said tamper evident compartment while the package is unopened, said removable cap being removable from said drinking straw after the user removes said second compartment from the package to remove contents from said first contents compartment and being subsequently resecureable to the portion of the drinking straw to prevent contents from the first contents compartment being removed therefrom to reseal the flexible package;

the flexible film having a grain to facilitate a tear extending straight across said drinking straw seal area, said grain facilitating tearing of said flexible film for removal of said tamper evident compartment.

3. A flexible package comprising an interior and an exterior, a first contents compartment formed from a sealed flexible film, a second tamper-evident compartment formed from said sealed flexible film, a drinking straw seal area between said first and said second compartments, a drinking straw extending from said first compartment to said second compartment through which a contents contained in said first compartment can pass, said drinking straw being fixedly sealed to said drinking straw seal area preventing movement of the drinking straw relative to said drinking straw seal area, the seal being fluid tight, whereby a user may remove said second compartment from the package and thereby gain access to said contents which can be removed from said first compartment through said drinking straw;

a removable and resecureable cap secured to a portion of said drinking straw which is extended into said tamper evident compartment, said cap capable of preventing fluid from said contents compartment from entering said tamper evident compartment while the package is unopened, said removable cap being removable from said drinking straw after the user removes said second compartment from the package to remove contents from said first contents department and being subsequently resecureable to the portion of the drinking straw to prevent contents from the first contents compartment being removed therefrom to reseal the flexible package;

said tamper evident compartment being die-cut so that said tamper evident compartment is of smaller size than said contents compartment, said package having inner corner areas adjacent said tamper evident compartment and said drinking straw seal area formed as a result of sad die cutting operation; and a score line extending from said inner corner areas through said seal area.

* * * * *